US009777456B1

(12) United States Patent
Spiro

(10) Patent No.: US 9,777,456 B1
(45) Date of Patent: Oct. 3, 2017

(54) UNIVERSAL POLE FOUNDATION

(71) Applicant: Daniel S. Spiro, Paradise Valley, AZ (US)

(72) Inventor: Daniel S. Spiro, Paradise Valley, AZ (US)

( * ) Notice: Subject to any disclaimer, the term of this patent is extended or adjusted under 35 U.S.C. 154(b) by 0 days.

(21) Appl. No.: 15/404,051

(22) Filed: Jan. 11, 2017

(51) Int. Cl.
*E02D 27/42* (2006.01)
*E04H 12/22* (2006.01)

(52) U.S. Cl.
CPC ..... *E02D 27/42* (2013.01); *E04H 12/2269* (2013.01); *E04H 12/2284* (2013.01); *E04H 12/2292* (2013.01); *E02D 2300/00* (2013.01); *E02D 2600/00* (2013.01)

(58) Field of Classification Search
CPC . E02D 27/42; E02D 2300/00; E02D 2600/00; E04H 12/2292; E04H 12/2284; E04H 12/2269; E04H 12/347; E04H 17/22
See application file for complete search history.

(56) References Cited

U.S. PATENT DOCUMENTS 1,611,935 A * 12/1926 Mitchell ..... E04H 12/2269 52/168
1,799,314 A * 4/1931 Pfaff ..... E04H 12/2269 211/119.01
7,765,770 B2 * 8/2010 Fournier ..... E02D 27/42 174/45 R
7,954,289 B2 * 6/2011 Evans ..... E04H 12/2269 248/530
8,966,837 B2 * 3/2015 Knudsen ..... E02D 5/226 52/165
2005/0051695 A1 * 3/2005 Kovach ..... A47G 33/12 248/524

* cited by examiner

*Primary Examiner* — Patrick J Maestri
(74) *Attorney, Agent, or Firm* — Schmeiser, Olsen & Watts LLP

(57) ABSTRACT

A pre-fabricated pole foundation provided employing a cavity to retain pole assembly of different profile, shape, size, and material interchangeably, a tapered structure onto which the pole rests, and recesses in the pole cavity wall enabling foundation hoisting, plumbing and anchoring, whereas the cavity wall is capable to accommodate for electronic devices enclosure and fill material provides structural support to an embedded pole or the embedded pole and foundation.

31 Claims, 11 Drawing Sheets

44
21
36
51

44
21
36
51

51
08
43
29
32
13

36
21
51

44
21
08
51

29
30
45
08
51

36
21
51

44
21
08
51

29
30
45
08
51

UNIVERSAL POLE FOUNDATION

BACKGROUND OF THE INVENTION

Technical Field

This invention relates generally to pole foundations and more particularly to a pre-fabricated pole foundation and method for installation to reduce pole assembly and erection time.

State of the Art

Conventional pole erection having a base plate requires lowering a pole onto a foundation with embedded threaded anchor bolts. The threaded anchor bolts pass through the pole's base plate. The pole is then secured to the foundation and then plumbed. The entire process of erecting a conventional pole and foundation is lengthy, requiring coordination between material suppliers and construction trades. The construction process is time sensitive. Coordinating multiple parties comes with risks of delay. These delay risks are compounded when having to work in outdoor conditions subject to unpredictable weather. Other drawbacks to the conventional pole erection method include: use of pole base plate adds cost to the pole and is foundation-specific, governed by anchor bolt bore spacing, having to refinish the above grade portion of the foundation following pole erection, corrosion exposure requiring periodic inspections and occasional maintenance work.

The process of erection of a conventional pole with base plate typically entails the following steps:

1. Ordering materials such as steel rebar, gravel, plywood and forms;
2. Scheduling on-site drop ship date for the above materials;
3. Ordering luminaires and poles, often requiring that anchor bolts pre-ship prior to balance of orders;
4. Building the steel cage for the foundation's structural reinforcement;
5. Employing wood template secure anchor bolts to steel cage;
6. Scheduling a date for concrete pour;
7. Auguring foundation bores and, where needed, providing bedding material for the foundation (weather permitting);
8. Dropping forms with rebar cage into bore plumb and securing them or dropping the steel rebar cage into the form after the form was plumbed and secured in bore. The steel rebar cage could be inserted inside the form or following;
9. Making all pre-pour electrical connectivity prep work;
10. Back filling and compacting soil around the form if needed;
11. Scheduling a crane;
12. Pouring concrete, vibrating inside form, and waiting until concrete cures;
13. Assembling pole and luminaire/s and/or other devices;
14. Using a crane to lower pole assembly on pole bases and securing pole to foundation with anchor bolt nuts;
15. Adjusting anchor bolt nuts to plumb the pole;
16. Removing above grade forms and refinishing the foundation's surfaces;
17. Pulling all electrical wiring and securing the hand hole cover to pole;
18. Placing pole base cover or architectural nut covers on anchor bolts;

19. Refinishing/touching up any scratches and removing dirt from pole and pole base; and
20. Powering up pole mounted devices and verifying proper operations.

The construction industry has a persistent need for an economical and rapid installation solution for erecting poles eliminating the drawbacks of the conventional means and methods.

SUMMARY OF THE INVENTION

The present invention relates to pre-fabricated pole foundation and method for installation to reduce pole assembly and erection time.

An embodiment includes a pre-fabricated pole foundation comprising: a cavity section having a pole cavity and a cavity wall having recesses; a core section having core walls; and a base section, wherein: the cavity section includes a tapered structure located on a bottom end of the pole cavity within the within the cavity wall; the tapered structure is configured to support a pole and operates as a pivot point to plumb the pole using alignment devices; and the tapered structure accommodates poles of dissimilar cross-sectional profiles, dimensions and material interchangeably; and cavity walls inner surfaces contain recesses that support pole aligning devices and may have through bores to facilitate anchoring the pole to the foundation.

Another embodiment includes a pre-fabricated pole foundation comprising: a cavity section having a pole cavity and a cavity wall having recesses; a bridge section located directly below the cavity section, the bridge section comprising an integral tapered structure supporting the pole or a keyed surface onto which a removable keyed tapered structure is coupled; a core section located having core walls, the core section located directly below the bridge section; and a base section located directly below the core section, wherein: tapered structure is configured to support a pole and operates as a pivot point to plumb the pole using alignment devices; and tapered structure accommodates poles of dissimilar cross-sectional profiles, dimensions and material interchangeably; and cavity walls inner surfaces contain recesses that support pole plumbing devices and may have through bores to facilitate anchoring the pole to the foundation; the tapered structure in one embodiment is capable of horizontal rotation for clocking the pole assembly.

Further, another embodiment includes a method of installing a pre-fabricated pole foundation and a pole assembly, the method comprising: forming bore within a portion of ground soil; hoisting and lowering a pre-fabricated pole foundation within the bore, wherein the pre-fabricated pole foundation comprises: a cavity section having a pole cavity, an cavity wall and a tapered structure located on a bottom end of the pole cavity within the within the cavity wall; a core section having core walls; and a base section; hoisting and lowering a pole assembly within the pole cavity of the cavity section of the pre-fabricated pole foundation; supporting the pole assembly on the tapered structure; pivoting the pole assembly on the tapered structure in response to operation of alignment devices to plumb the pole assembly; and filling open spaces between core walls and the pole cavity with granular or similar structural propertied material and anchoring the pole to the foundation if required and capping the top of pole cavity with grout or similar material as well as lead bores if exist at the exterior walls of pole cavity opening.

Yet another embodiment includes a pre-fabricated pole foundation comprising: an upper portion having a pole cavity for receiving and retaining a pole and a cavity wall; and a lower portion located below the upper portion, wherein the upper portion includes a tapered structure located at the bottom end of the pole cavity within the cavity wall, wherein the tapered structure is configured to support the pole and operate as a pivot point to plumb the pole using alignment devices wherein the tapered structure accommodates poles of dissimilar cross-sectional profiles, dimensions, and material interchangeably; wherein the tapered structure may be detachable and keyed; and a plurality of recesses in the inside of the pole cavity walls provide anchoring location to at least pole hoisting devices, pole plumb devices and pole anchoring devices, wherein the pole cavity is configured to receive fill material through the pole cavity top end and fill voids between the cavity wall and the pole exterior surface to provide lateral support to embedded pole.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1C:
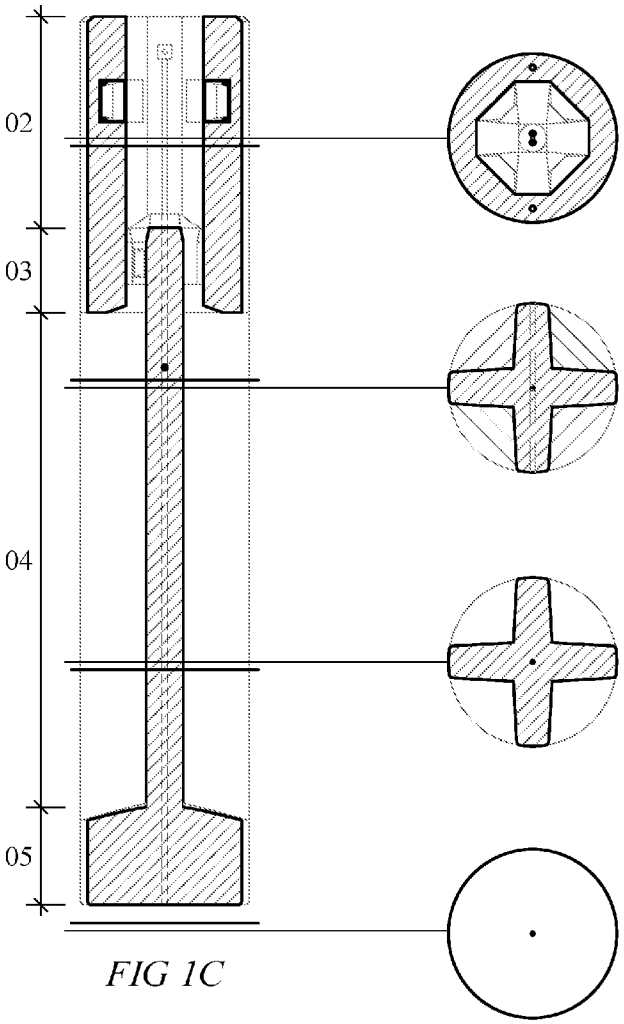
FIG. 1C is a section view of a pole foundation in accordance with an embodiment.
Figure 1B:
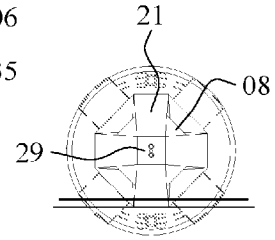
FIG. 1B is a top view of a pole foundation in accordance with an embodiment.
Figure 1A:
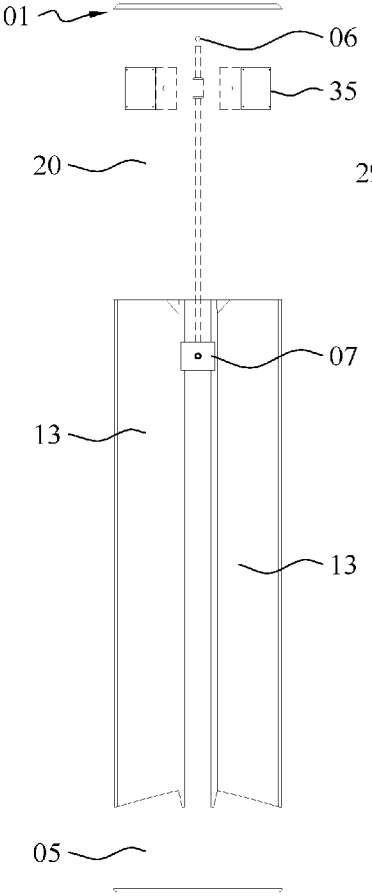
FIG. 1A is a side view of a pole foundation in accordance with an embodiment.
Figure 2C:
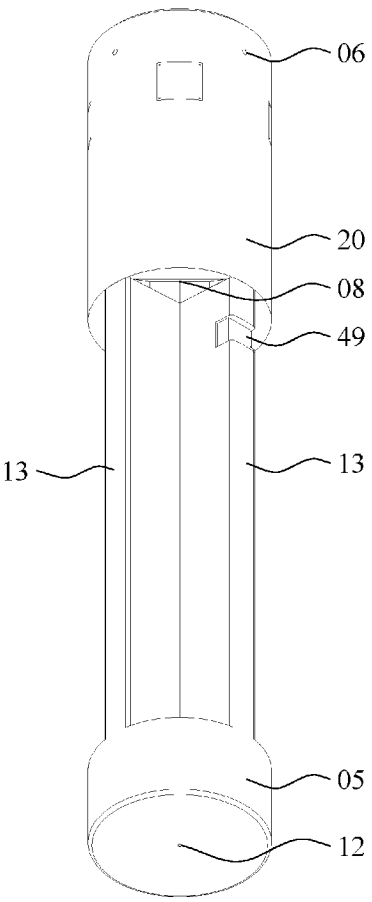
FIG. 2C is a bottom perspective view of a pole foundation in accordance with an embodiment.
Figure 2B:
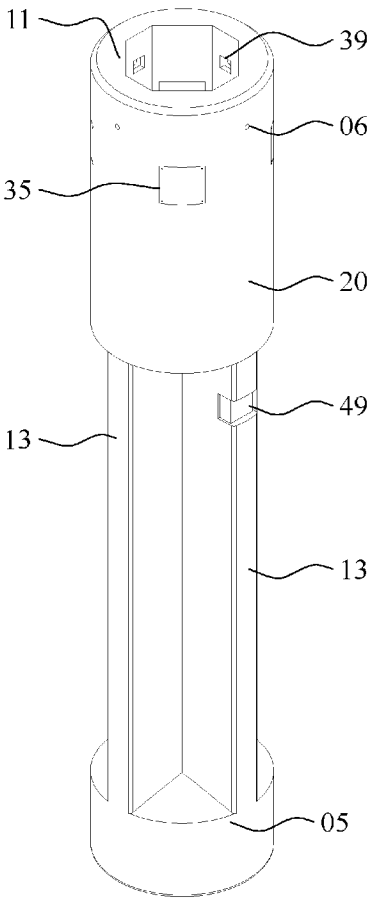
FIG. 2B is a top perspective view of a pole foundation in accordance with an embodiment.
Figure 2A:
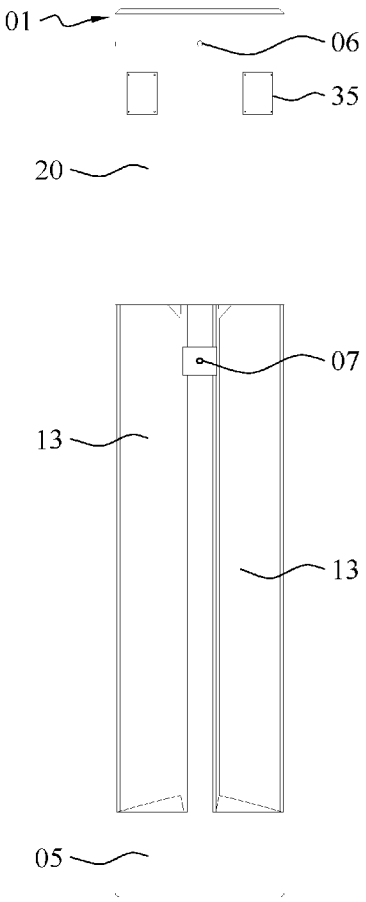
FIG. 2A is a side view of a pole foundation in accordance with an embodiment.

As discussed above, embodiments of the present invention relate to pre-fabricated pole foundation and method for installation to reduce pole assembly and erection time.

To mitigate drawbacks associated with the process of conventional pole erection, the present invention includes and employs two pre-fabricated elements, namely a foundation and pole free of base plate notwithstanding the specified device/s assembly on the pole.

Eliminating the pole base plate from the pole, along with its anchor bolts, provides the ability for the foundation to accept a variety of pole cross-sectional profiles, dimensions and materials. In general use, the pre-fabricated foundation arrives on site ready to be lowered into an excavated bore absent of any structural or architectural imperfections. The pre-fabricated foundation construction fabrication is consistent across wide geographical areas, eliminating dependency on local contractor skill level. The two assembly elements, the pre-fabricated pole foundation and the pole joined together operates to remove several steps from the process of erecting a conventional pole. The steps removed include:

1. Ordering material such as steel rebar, gravel, plywood and forms. Aside from foundation, the only material needed is granular fill or similar material in structural property;
2. Ordering anchor bolts and making pre-ship arrangements;
3. Building a steel rebar cage;
4. Building anchor bolt templates and securing them to cage;
5. Scheduling a concrete pole;
6. Dropping forms into augured bores;
7. Pouring concrete and waiting for the concrete to cure;
8. Securing pole to foundation and plumbing using anchor bolt;
9. Removing form from above grade;
10. Refinishing pole foundation above grade; and
11. Concealing anchor bolts using bolt covers or base plate cover.

In addition, post-construction steps removed include:

1. Periodical corrosion inspection;
2. Periodical maintenance work;

In addition, pre-fabricated opening/s with or without conduit/s embedded in the pre-fabricated foundation enable the pre-fabricated pole foundation to ground electrical devices as well as to retain related and non-related pole assembly devices. Such devices may include input sensory devices such as accelerometer, noise, pollution, camera and/or input/output or output devices such as a transceiver, surge protector and receptacle for a vehicle charger or a receptacle for a temporary holiday lighting display. Both foundation and pole can easily be removed intact, and be re-used should the need arise. The streamlining of the pole erection process, employing the present innovation, reduces production time from weeks to only a matter of hours and days Foundation Structural Design FIGS. 1A-2C, depict an embodiment of a pre-fabricated pole foundation 1. The pre-fabricated pole foundation 1 may be divided into four sections along a vertical axis of the pre-fabricated pole foundation 1. The four section include a pole cavity section 2 located at a top of the pre-fabricated pole foundation 1, a bridge section 3 located directly below the pole cavity section 2, a core section 4 located directly below the bridge section 3, and a base section 5 located at a bottom of the pre-fabricated pole foundation 1. In these embodiments, the pre-fabricated pole foundation 1 includes an upper portion that may include the pole cavity section 2 and a bridge section 3, and further may include a lower portion that may include the core section 4 and the base section 5. In at least this way the upper portion may include a pole cavity section 2 and/or a bridge section 3, and the lower portion may include a core section 4 and/or a base section 5.

Figure 4F:
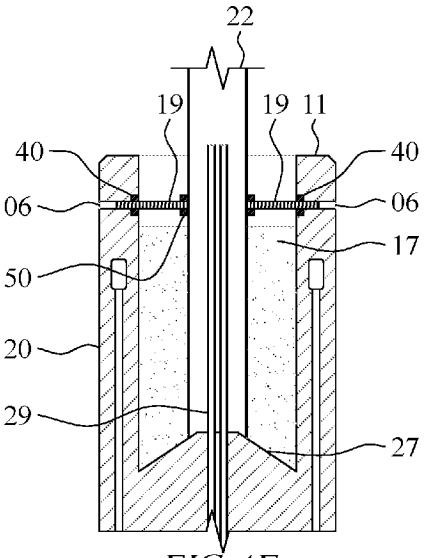
FIG. 4F is a side section view of a pole placed and secured within a pole foundation in accordance with an embodiment.
Figure 4D:
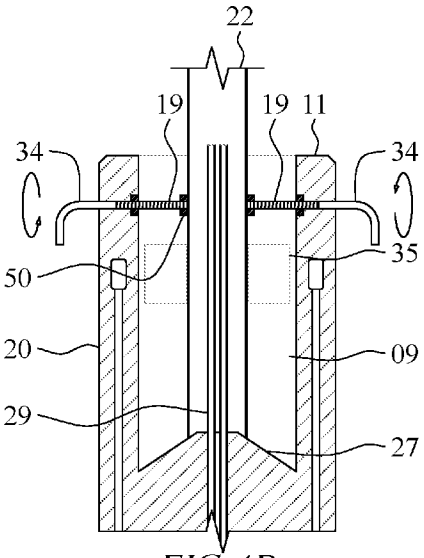
FIG. 4D is a side section view of a pole placed and secured within a pole foundation in accordance with an embodiment.
Figure 4B:
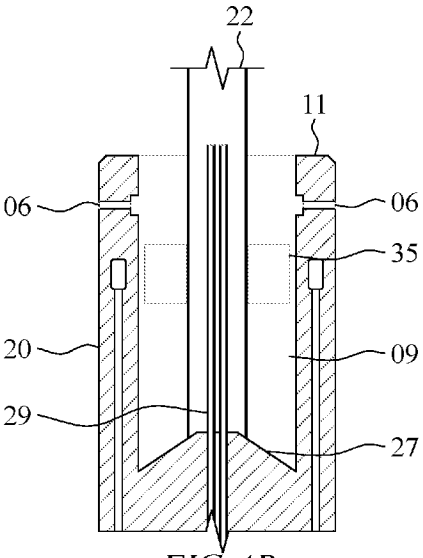
FIG. 4B is a side section view of a pole placed within a pole foundation in accordance with an embodiment.
Figure 4E:
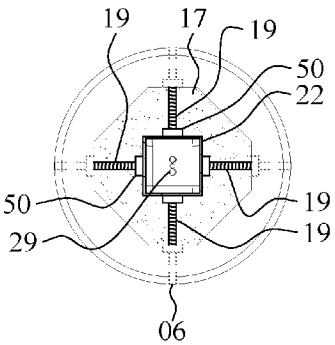
FIG. 4E is a top view of a pole placed and secured within a pole foundation in accordance with an embodiment.
Figure 4C:
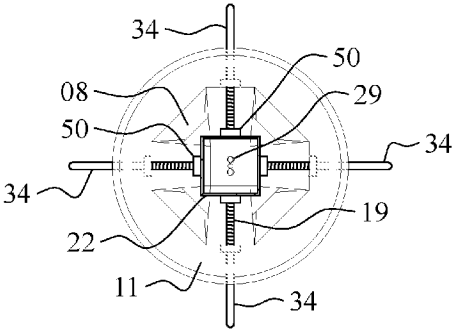
FIG. 4C is a top view of a pole placed and secured within a pole foundation in accordance with an embodiment.
Figure 4A:
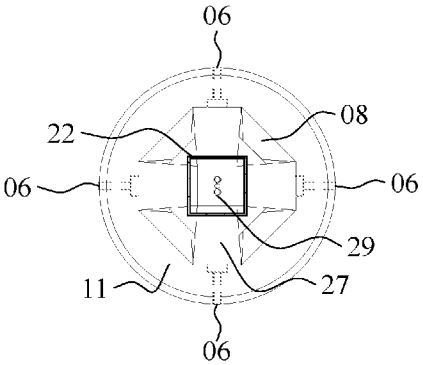
FIG. 4A is a top view of a pole placed within a pole foundation in accordance with an embodiment.
Figure 4L:
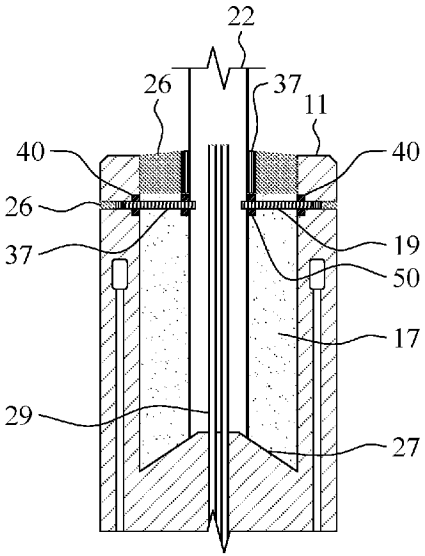
FIG. 4L is a side section view of a pole placed and secured within a pole foundation with a cap installed in accordance with an embodiment.
Figure 4K:
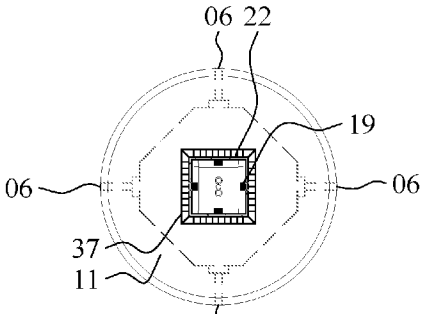
FIG. 4K is a top view of a pole placed and secured within a pole foundation with a cap installed in accordance with an embodiment.
Figure 4J:
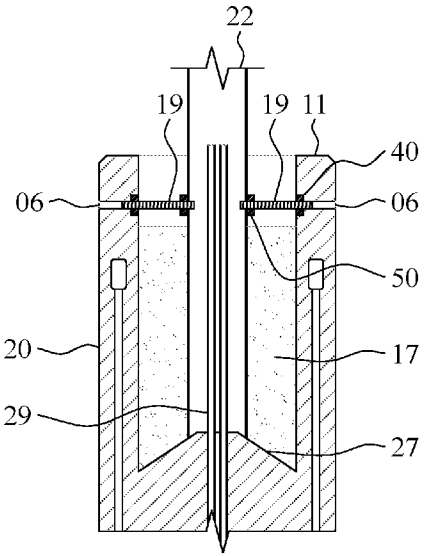
FIG. 4J is a side section view of a pole placed and secured within a pole foundation with anti-rotation/uplift bolts in accordance with an embodiment.
Figure 4I:
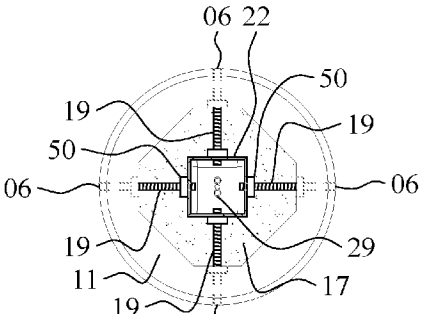
FIG. 4I is a top view of a pole placed and secured within a pole foundation with anti-rotation/uplift bolts in accordance with an embodiment.
Figure 4H:
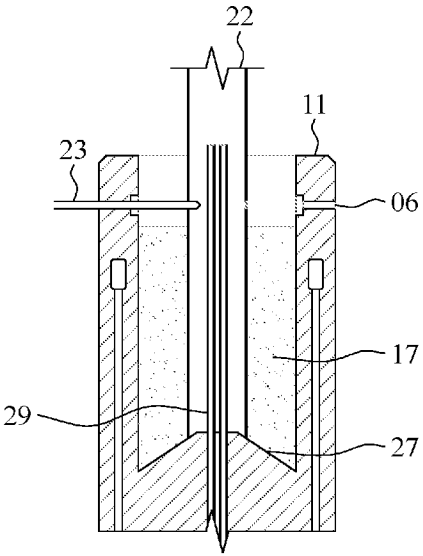
FIG. 4H is a side section view of a pole placed within a pole foundation and a pole drill drilling into the pole in accordance with an embodiment.
Figure 4G:
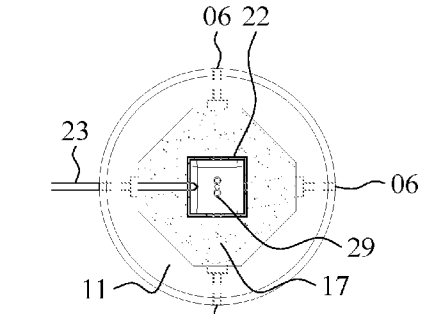
FIG. 4G is a top view of a pole placed within a pole foundation and a pole drill drilling into the pole in accordance with an embodiment.
Figures 5A, 5B, 5C, 5D:
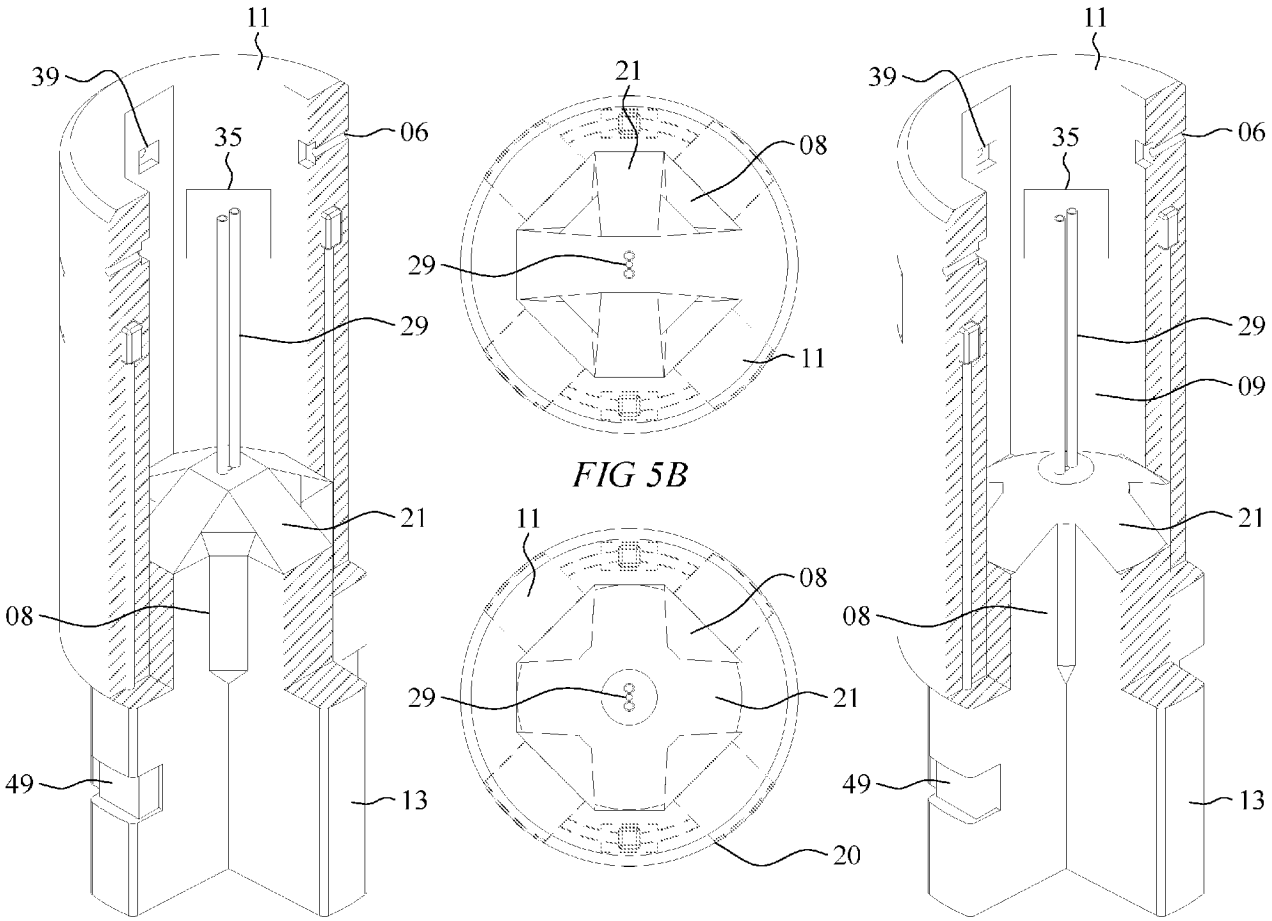
FIG. 5A is a partial section view of a top portion of a pole foundation for use with a square pole in accordance with an embodiment.
FIG. 5B is a top view of a top portion of a pole foundation for use with a square pole in accordance with an embodiment.
FIG. 5C is a top view of a top portion of a pole foundation for use with a round pole in accordance with an embodiment.
FIG. 5D is a partial section view of a top portion of a pole foundation for use with a round pole in accordance with an embodiment.

The pole cavity section 2 has a primary purpose to receive and retain an embedded pole 22 within a cavity 9 (See FIG. 4B). At a center of the cavity 9 bottom, a tapered structure 21 provides a support location for a bottom of the pole 22. At the upper regions of the cavity wall 20 a plurality of through leader bores 6 having a recess 39 at the interior surface of cavity wall 20, the recess 39 utilized to plumb the pole 22 when pole does not require anchoring. When pole 22 requires anchoring against rotation and uplift, recess 39 and leader bore 6 may be utilized to plumb the pole 22. Each through leader bore 6 has a horizontal axis that intersects the vertical axis of the pre-fabricated pole foundation 1. These bores 6 and corresponding recesses 39 may also serve as a hoisting attachment location to lower the foundation into the augured bore in the soil. In another embodiment, a continuous recess at the outside diameter wall 20 of the cavity section 2 provides an alternate pre-fabricated pole foundation 1 hoisting location.

Figures 6A, 6B, 6C, 6D, 6E, 6F, 6G, 6H, 6I:
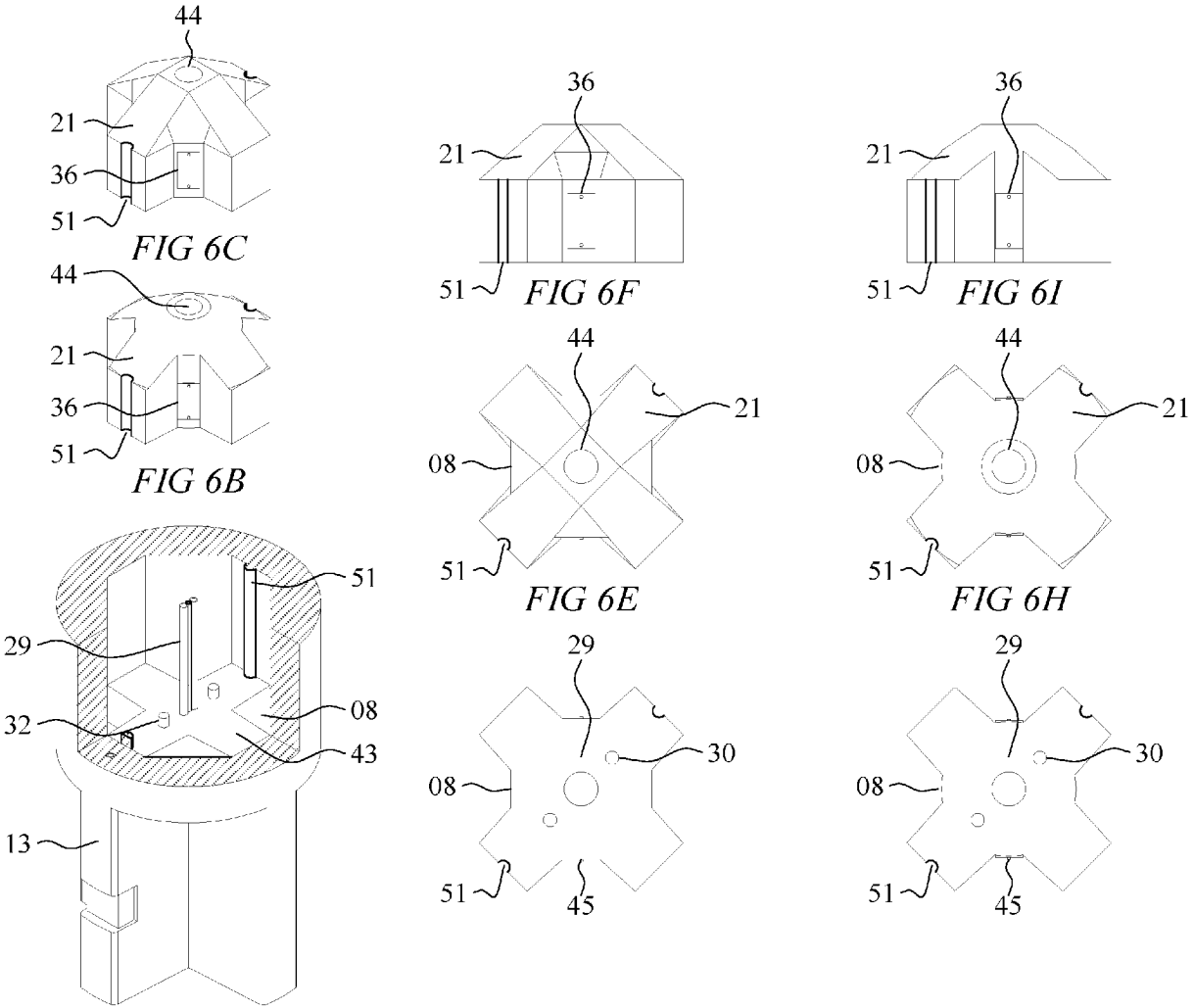
FIG. 6A is a partial section view of a pole foundation in accordance with an embodiment.
FIG. 6B is a perspective view of a round pole insert in accordance with an embodiment.
FIG. 6C is a perspective view of a square pole insert in accordance with an embodiment.
FIG. 6D is a bottom view of a square pole insert in accordance with an embodiment.
FIG. 6E is a top view of square pole insert in accordance with an embodiment.
FIG. 6F is a side view of a square pole insert in accordance with an embodiment.
FIG. 6G is a bottom view of a round pole insert in accordance with an embodiment.
FIG. 6H is a top view of round pole insert in accordance with an embodiment.
FIG. 6I is a side view of a round pole insert in accordance with an embodiment.
Figure 7F:
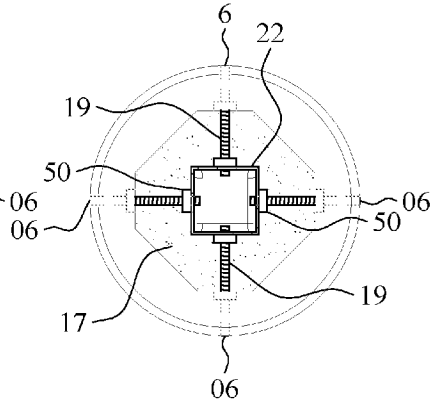
FIG. 7F is a top view of a top portion of a pole foundation with anchoring in accordance with an embodiment.
Figure 7D:
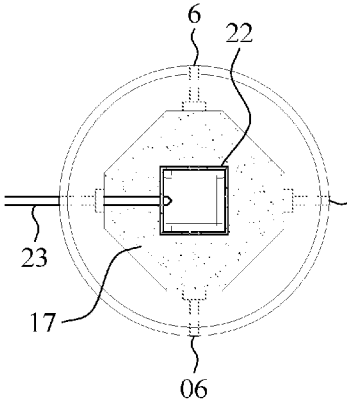
FIG. 7D is a top view of a top portion of a pole foundation showing drilling for anchoring in accordance with an embodiment.
Figure 7B:
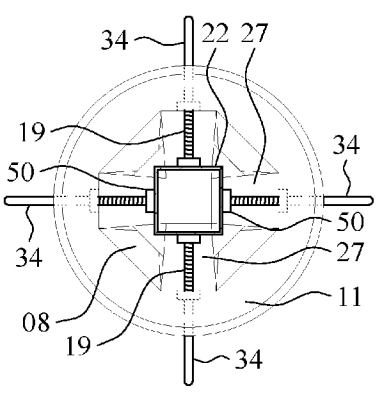
FIG. 7B is a top view of a top portion of a pole foundation with pole plumbing in accordance with an embodiment.
Figure 7E:
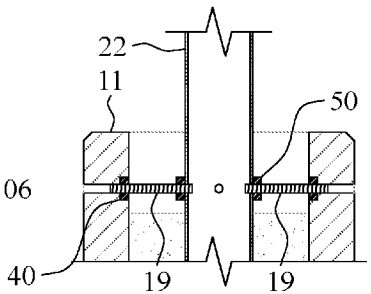
FIG. 7E is a side section view of a top portion of a pole foundation with anchoring in accordance with an embodiment.
Figure 7C:
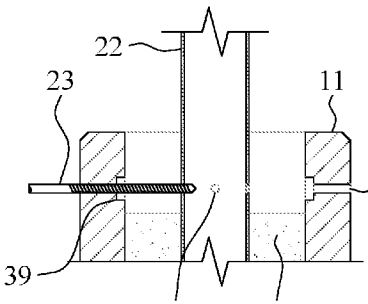
FIG. 7C is a side section view of a top portion of a pole foundation showing drilling for anchoring in accordance with an embodiment.
Figure 7A:
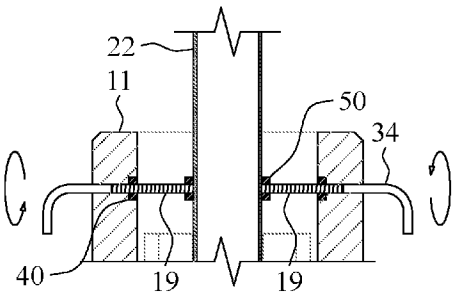
FIG. 7A is a side section view of a top portion of a pole foundation with pole plumbing in accordance with an embodiment.
Figure 8C:
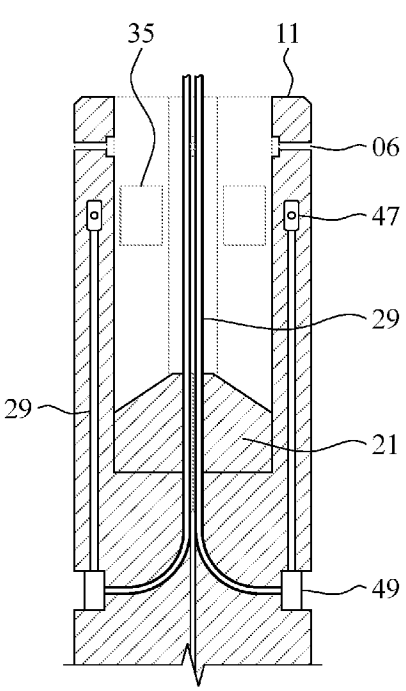
FIG. 8C is a section view of a pole foundation with power and/or data connectivity components in accordance with an embodiment.
Figure 8B:
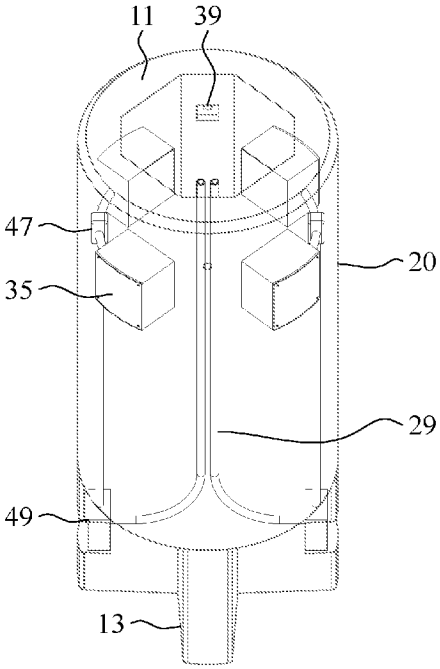
FIG. 8B is a perspective view of a pole foundation with power and/or data connectivity components in accordance with an embodiment.
Figure 8A:
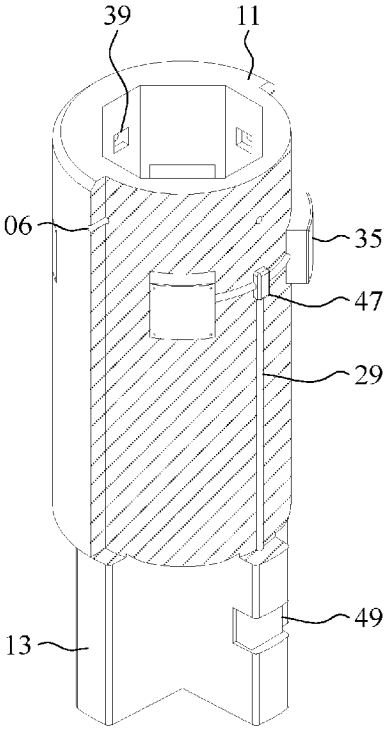
FIG. 8A is a partial section perspective view of a pole foundation with power and/or data connectivity components in accordance with an embodiment.
Figure 9C:
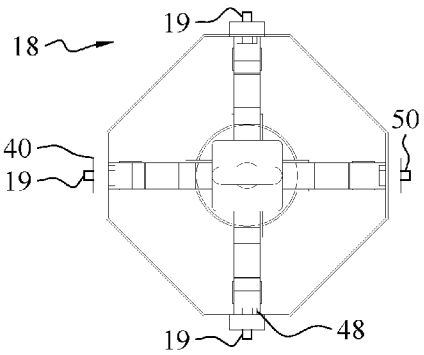
FIG. 9C is a top view of an installation device for use with a pole foundation in accordance with an embodiment.
Figure 9D:
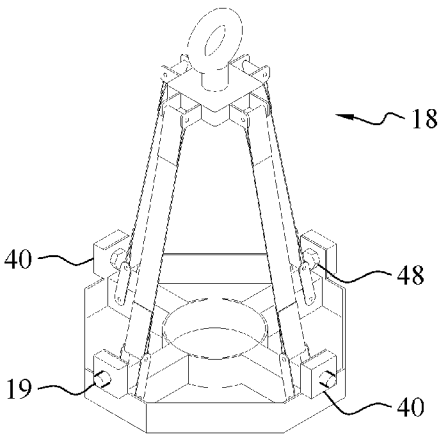
FIG. 9D is a perspective view of an installation device for use with a pole foundation in accordance with an embodiment.
Figure 9B:
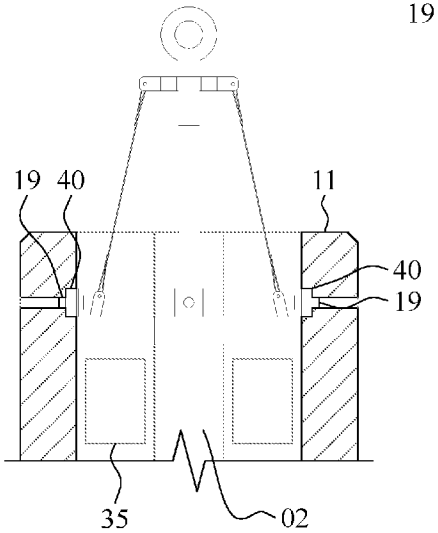
FIG. 9B is a section view of an installation device for use with a pole foundation in accordance with an embodiment.
Figure 9A:
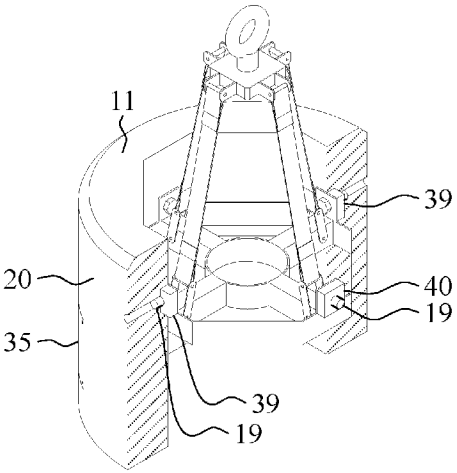
FIG. 9A is a partial section perspective view of an installation device for use with a pole foundation in accordance with an embodiment.
Figure 10A:
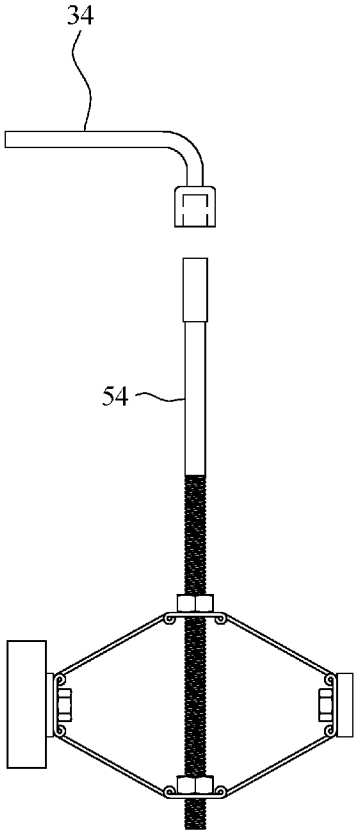
FIG. 10A is an elevation view of a removable pole alignment device.
Figure 10B:
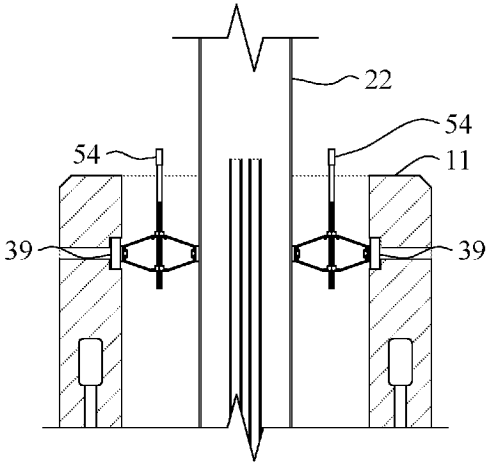
FIG. 10B is a section view of the removable alignment device engaged inside a pole cavity in accordance with an embodiment.
Figure 10C:
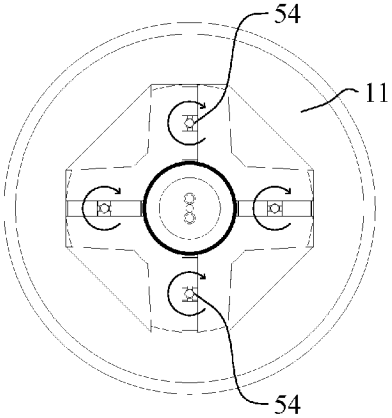
FIG. 10C is a plan view of the removable alignment device engaged in pole cavity in accordance with an embodiment.

The cavity walls 20 may also retain electronic devices and/or enclosures and connectivity inside the pole cavity 9, in the pole cavity walls 20 and/or the pole cavity walls 20 exterior. The bridge section 3 top surface forms the tapered structure 21 providing support for the pole 21 when the pole is received within the cavity 9 of the cavity section 2. The tapered structure 21 can be made of the same material as the pre-fabricated pole foundation 1, and may be formed with the pre-fabricated pole foundation 1 as a unitary piece, as shown in FIGS. 1A-5D. In another embodiment the pre-fabricated manufacturing of the pre-fabricated pole foundation 1 may be simplified by removing alternative types of tapered structures 21, wherein the bridge section 3 top surface 43, having at its center through conduit/s 29 and between its parameter edges and its center, protrusions 32 acting as keyed elements to lock a pre-fabricated tapered structure 21 in position. This system and method reduces the pre-fabricated pole foundation 1 structure to a single product for a given range of pole's profile width and the choice of a keyed tapered structure insert 21 to a square (See FIGS. 6D-6F) or a round pole option (See FIGS. 6G-6I). The tapered structure insert 21 is made of hardened material and may have internal cavities 30 to correspond to the protrusion 32. In some embodiments, the top surface 43 may include recesses and the tapered structure inserts 21 may include protrusions in order to act as keyed elements to lock the pre-fabricated tapered structure 21 in position. In some embodiments, the tapered structure 21 may also be constructed of two parts having low friction contact surfaces enabling the top part to horizontally rotate, facilitating easier pole clocking. In one embodiment, guidelines along the pole cavity walls with corresponding profile niches or protrusions at the insert outer parameter facilitate quick insertion.

At a vertical center of the bridge section 3, through conduit/s 29 allow a variety of wiring to run from below grade to the cavity section 2. Such wiring may also include ground wire. The bridge section's 3 outer walls are an extension of the cavity section wall 20. A through opening(s) 8 between the bridge section 3 cross-like inner tapered structure 21 at its center and the inner surface of the wall 20 to allow for granular fill material 17 or fill material 17 having similar structural properties to reach the core section 4 below the bridge section 3. Also, this opening permits moisture from above to seep through and thereby prevent issues caused by accumulated moisture. The vertical depth of the bridge may variable contingent on the axial load and lateral forces acting on the pole 22.

Figures 3A, 3B, 3C, 3D:
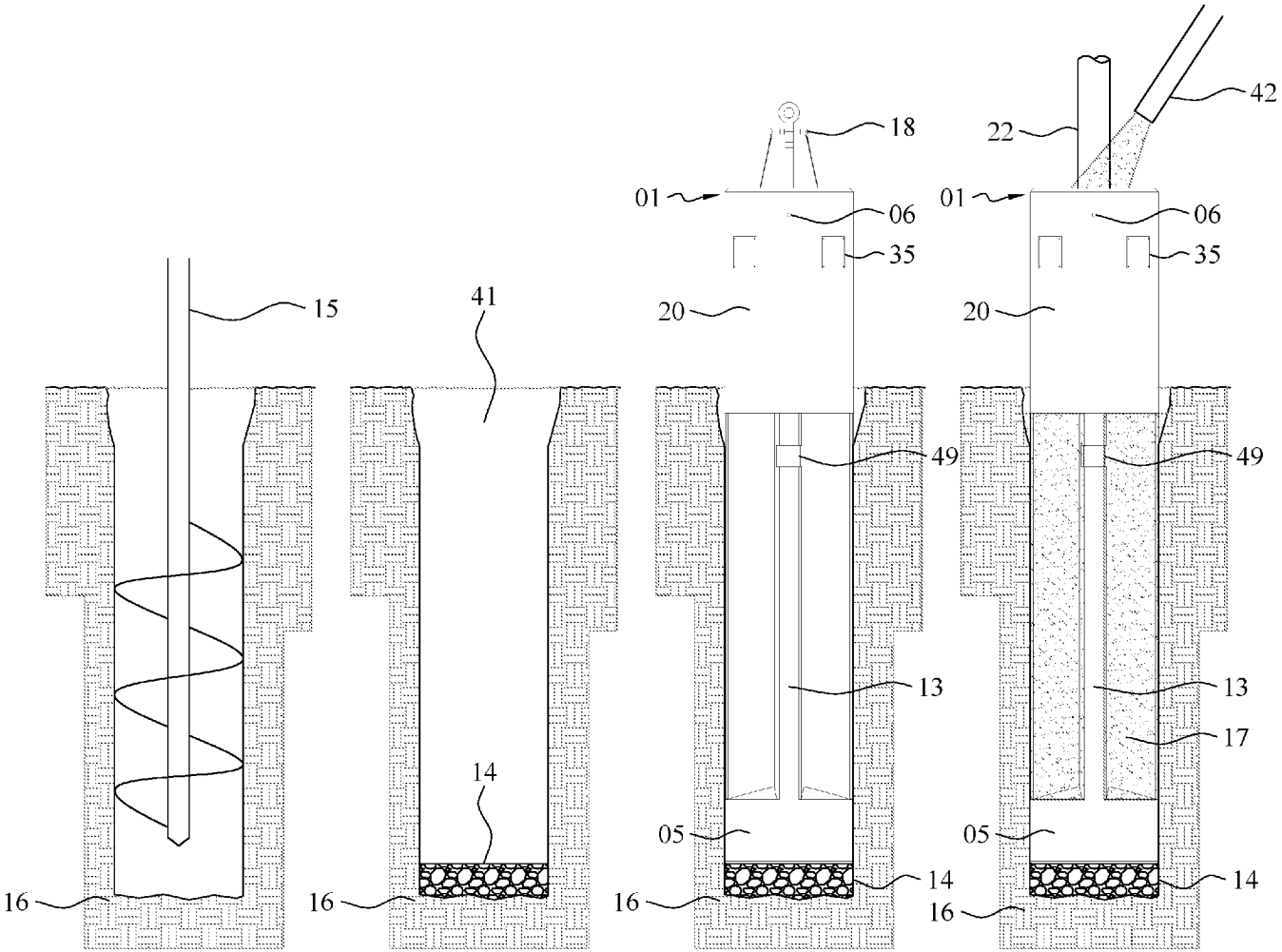
FIG. 3A is a side view of an auger forming a bore in soil in accordance with an embodiment.
FIG. 3B is a side view of bedding material added within the bore as needed in accordance with an embodiment.
FIG. 3C is a side view of a pole foundation lowered into the bore in accordance with an embodiment.
FIG. 3D is a side view of a pole foundation secured within a bore in accordance with an embodiment.

The core section 4 provides structural continuity from the cavity section 2 and bridge section 3 to the base section 5. Further, the core section 4 provides frictional and lateral resistance of the pre-fabricated pole foundation 1. The cores section 4 comprises a plurality of core walls 13 that are spaced annularly around the vertical axis of the pre-fabricated pole foundation 1. The core walls 13 may form a cross-shaped cross section, wherein the core walls 13 intersect and the through openings 8 for the tapered structure 21 are located above the intersection of the core walls 13 to allow granular or similar in structural properties material to reach the core section 4 through the bridge section 3. The fill material 17 may be wedged between the core walls 13 and the excavated bore 41, as shown in FIG. 3D. Where forms are needed, the fill material 17 is wedged between the core walls 13 and the form wall.

The base section 5 supports the entire load of the pole 22 and its assembly and the pre-fabricated pole foundation 1. In embodiments, the base section 5 diameter is the same diameter as the exterior cavity wall 20 of the cavity section 2. In special applications, where spread footing is needed, a keyed recess or protrusion at the bottom of the base section 5 anchors the pre-fabricated pole foundation 1 to a reciprocating key at the top of the spread footing.

Foundation Electrical Design

Referring to FIGS. 5A-5D and 8A-8C, the pre-fabricated pole foundation 1 enables both power and data to extend from below grade to one of the pole, the pole cavity, the pole cavity wall, the pole cavity wall exterior or combinations thereof. At the core section 4 the core walls 13 or recessed inside the core walls are non-corrosive J boxes 49 that are sealed to the elements. These J boxes 49 are foundation entry portals for power and data. Conduits 29 may travel from these portals through the bridge section 3 into the pole 22, or travel through the cavity wall 20 to electrical/data device enclosures 35 embedded in the pole cavity wall 20 or to the pole cavity wall 20 interior/exterior surfaces. Some embodiments may have a combination of the above and may also have power and/or data enter from below grade directly into the pole cavity 9 through the filled granular or similar in structural properties material. The conduit 29 rising from below grade through the pole cavity wall 20 may employ a splice box or a junction box 47 also embedded in the wall 20 and may divert power or divert power and data to a plurality of openings and/or enclosures 35 in the cavity wall 20. Through the vertical center of the foundation from the pole cavity 9 down to the foundation base 5 a pre-fabricated bore may house a grounding wire. That grounding wire at the foundation base connects to a grounding spike, grounding the pole 22 or the pole 22 and pole cavity 9 devices.

Foundation Material and Fabrication

The pre-fabricated pole foundation 1 can be made of concrete or any other flame-retardant, structurally-sound, lightweight material. The pre-fabricated pole foundation 1 wall design may incorporate impact-absorbing material and/or be constructed to absorb impact, reducing health risks to humans. Some pre-fabricated pole foundation 1 material may also be shipped to site, broken down to separate sections with capacity to be quickly assembled onsite. The pre-fabricated pole foundation 1 can be fabricated by the process of casting, molding, 3D printing or any other methods or combination thereof.

It has been contemplated that the component of the pre-fabricated pole foundation 1 may be formed completely from cement or some type of cement mixture in a cast or the like. It has further been contemplated that the components of the pre-fabricated pole foundation 1 may be formed of a polymer material or material having polymer-like structural properties including but not limited to fire-resistant material and/or non-corrosive material. Further, in embodiments of the pre-fabricated pole foundation 1 formed of a polymer material, some or all of the components may have a honeycomb structure and/or other cellular structure. For example and without limitation, at least one of the cavity section, the bridge section, the core section, the base section, or combinations thereof comprise a honeycomb structure. Forming the pre-fabricated pole foundation 1 of a polymer and further having a honeycomb structure results in a pre-fabricated pole foundation 1 having much less weight than cement foundation for supporting the same size pole assembly. The polymer and honeycomb design also provide for shock absorbing characteristics that are improved over cement pole foundations. The polymer with or without the honeycomb structure provides for reduced weight foundation that further does not change the structural integrity required for the support and operation of a pole assembly.

Additionally, the soil type in which the pre-fabricated pole foundation 1 is installed provides certain characteristics that determine the size of pre-fabricated pole foundation 1. The soil properties may require that for a certain weight of a pre-fabricated pole foundation 1 and pole assembly installed the foundation needs to be a certain size within the soil in order to provide the necessary normal force to support the foundation and pole assembly installed properly. This very much dependent on the weight of the foundation and pole assembly. An easy way to reduce the size of the pre-fabricated pole foundation 1 is to form it of polymer and insert honeycomb structure to reduce material and weight. Because of the lighter combined weight of the pre-fabricated pole foundation 1 and the pole assembly, the pre-fabricated pole foundation 1 may require a smaller foundation base surface area to support the combined weight, thereby allowing for a smaller shaped pre-fabricated pole foundation 1 that would be needed in a comparable cement pole foundation, and thereby requiring less material and space for storing and shipping and for easier installation of pre-fabricated pole foundation 1.

Weight Consideration in Design

The economic feasibility of the pre-fabricated pole foundation 1 is to a large degree dependent on the proximity of a fabrication plant to a construction site. The greater the distance, the higher the transportation cost. Granular or similar in structural properties material cost is low and the material is typically readily available in proximity to construction sites. To reduce transportation cost, the pre-fabricated pole foundation 1 design cores or removes any excess weight while maintaining full structural integrity.

Pole Assembly Erection Process

The key steps to erecting a pole assembly are generally shown in FIGS. 3A-3D, 4A-4L, 9A-9D, and 10A-10C. These steps include for example: Auger a bore 41 in the soil 16 using an auger bit 15. The bore 41 may be slightly larger than the pre-fabricated pole foundation 1 diameter minimally disturbing the surrounding soil. Where soil 16 is unstable, excavation pit width may be wide enough to accommodate a pre-fabricated form slightly larger in diameter of the pre-fabricated pole foundation 1. Both bore 41 and excavated pit depth are contingent on structural specification and may include additional depth for bedding 14. When using the excavated method following the insertion of the form in the pit, plumb the form and anchoring it, the gap between the undisturbed soil and the form may be back filled, vibrated and compacted.

In order to insert pre-fabricated pole foundation 1 into the bore 41, hoisting harness 18 is inserted and secured in pre-fabricated pole foundation 1 using pole cavity wall insert plates 40 that are inserted within recesses 39. A connector 48 may then be used to connect the hoist 18 to the insert plates 40. The pre-fabricated pole foundation 1 may then be lifted and then lowered into the bore 41 or the form.

Once the pre-fabricated pole foundation 1 is lowered within the bore 41, the pole 22 may be lifted and lowered through the cavity 9 until the pole bottom end rests on the tapered structure 21 at the bottom center of the cavity.

Plumb devices 34 or 54 may be utilized to apply multi-directional lateral force at the upper region of the cavity wall 20 while having the tapered pole support structure 21 as a pivot point to plumb the pole. When there is no need to anchor the pole, removable expandable alignment devices 54 can be wedged between the pole and the recesses 39 in the foundation cavity wall. In operation, the expandable alignment devices 54 may include an actuator that may be manually operated with a tool 34, such as, but not limited to a wrench, to turn the actuator and extend the expandable alignment devices 54 laterally between the cavity wall 20 and the pole 22 in order to apply force to the pole 22 to pivot the pole 22 about the tapered structure for alignment. Use of three or four expandable alignment devices 54 work to plumb the pole by rotating the actuators gradually and in a controlled manner, the pole 22 may be made plumb. In another embodiment the expandable and removable plumbing devices can be substituted by the plumb devices 34 that may comprise bolts and threaded retainer plates 40. The threaded retainer plates 40 are anchored in recesses 39 located at the cavity interior surface of wall 20. By rotating the bolts gradually and in a controlled manner, the pole 22 may be made plumb. These plumb devices 34 may be used for both making the pole plumb and anchoring the pole against rotational and uplift forces.

After pole 22 has been made plumb, granular fill material 17 or fill material 17 similar in structural properties, such as, but not limited to granular fine material may be poured into the pre-fabricated pole foundation 1 through the cavity 9 through the opening 8 of the tapered structure 21 and into the core section 4 between the core section 4 and the bore 41 opening to a level just below the alignment devices 34. The alignment or plumb devices 34 may be removed and replaced with anchoring bolts if anchoring is needed. Prior to inserting anchoring bolts, a drill bit may be inserted through the leader bore holes 6 to drill a bore inside the pole 22. The anchoring bolts may be inserted through the leader bore holes 6 and through their respective recesses 39, and then, thread the alignment bolt back through the leader bores until it penetrates the pole 22. In a similar embodiment, the bolt can be inserted through the foundation's wall cavity opening 9. Both methods secure the pole 22 against rotation and uplift forces. Following the securing of the bolts to the pole, additional granular fill material 17 or fill material 17 with similar structural properties may be added above bolts. The fill material 17 may be vibrated to assure filling any voids from the bottom of core section 4 to top of pole cavity 9.

A grout or similar material cap 26 may fill the inner top of the pole cavity 9 having a slope away from pole. Elastomeric or similar material properties form a material break between pole and grout-like material to eliminate stress on the grout cap. Further, plugs may be inserted within the leader bore 6 (if applicable) at the foundation's cavity exterior walls 20. Prior to plugging the bores 6, insert material break filler may be inserted within the bores 6 to avoid grout bonding to bolts. Both the pole 22 and the foundation 1 are designed to facilitate easy replacement. Replacement only requires breaking the grouted fill seal and removing the plugin of fills at the cavity walls.

According to some embodiments, a method of installing a pre-fabricated pole foundation and a pole assembly includes: forming bore within a portion of ground soil; hoisting and lowering a pre-fabricated pole foundation within the bore, wherein the pre-fabricated pole foundation comprises: a cavity section having a pole cavity, an cavity wall and a tapered structure located on a bottom end of the pole cavity within the cavity wall; a bridge section having an integral or a detachable tapered structure; a core section having core walls; and a base section; hoisting and lowering a pole assembly within the pole cavity of the cavity section of the pre-fabricated pole foundation; supporting the pole assembly on the tapered structure; pivoting the pole assembly on the tapered structure in response to operation of alignment devices to plumb the pole assembly; and filling with fill material open voids from the core section, through the bridge section up to the cavity section, wherein the fill material is level below a top of the cavity section.

The method may further include diverting moisture collection in and around the pole through the fill material; and grounding a pole assembly in response to extending a ground wire through a foundation vertical center opening and connecting the ground wire to a spike mounted to the base section.

The installation of the pole assembly may include bringing power to the foundation and, through embedded conduits in the foundation, and run power to pole-mounted and pole cavity embedded devices. The installation may also include terminating grounding wire, placing, if needed, a surge protector and/or other devices at the pole base and/or pole cavity wall and then power up the assembly and verify proper operation.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A pre-fabricated pole foundation comprising:
a cavity section having a pole cavity and a cavity wall;
a bridge section at the bottom of the cavity section;
a core section having core walls; and
a base section, wherein:
the bridge section includes a tapered structure located on a top end of the bridge section adjacent to a bottom end of the pole cavity and accessible within the cavity wall, the tapered structure comprising openings;
the tapered structure supports a pole received and embedded within the cavity section and operates as a pivot point to plumb the pole using removable alignment devices;
the tapered structure accommodates poles of dissimilar cross-sectional profiles, dimensions and material interchangeably; and
the pre-fabricated pole foundation receives fill material through the top end of the foundation cavity and through the openings in the bridge structure and fill voids throughout the core, bridge and pole cavity sections from the pre-fabricated pole foundation's base upwardly wherein the fill material provides lateral support between the cavity wall and an embedded pole and maintains alignment of the embedded pole.

2. The pre-fabricated pole foundation of claim 1, wherein said pre-fabricated pole foundation and pole are configured to be separately removed from each other intact and re-used.

3. The pre-fabricated pole foundation of claim 1, further comprising at least one opening in the cavity wall for retaining one of power enclosures, data device enclosures, or combinations thereof.

4. The pre-fabricated pole foundation of claim 1, further comprising an opening extending through a vertical center, wherein the opening is configured to receive a ground wire through the foundation vertical center for connecting to a spike mounted to the base section for grounding a pole assembly.

5. A pre-fabricated pole foundation of claim 1, further comprising a plurality of recesses extending radially in the pole cavity inner wall providing anchoring locations to at least a pole hoisting device, a pole plumb device and a pole anchoring device.

6. The pre-fabricated pole foundation of claim 5, further comprising leader bores extending radially through the cavity wall and through the recesses located in an interior surface of the cavity wall, wherein the recesses receive and retain plates and bolts that facilitate pole plumbing and retain at least one plate and bolt for anchoring.

7. The pre-fabricated pole foundation of claim 6, wherein the plates facilitate hoisting locations for the pre-fabricated pole foundation.

8. The pre-fabricated pole foundation of claim 1, wherein the pre-fabricated pole foundation is formed of a non-corrosive material.

9. A pre-fabricated pole foundation comprising:
a cavity section having a pole cavity and a cavity wall;
a bridge section located directly below the pole cavity section, the bridge section comprising a keyed surface;
a keyed tapered structure removably coupled to the keyed surface of the bridge section;
a core section having core walls, the core section located directly below the bridge section; and
a base section located directly below the core section, wherein:
the keyed tapered structure is configured to support a pole and operates as a pivot point to plumb the pole using removable alignment devices; and
the keyed tapered structure accommodates poles of dissimilar cross-sectional profiles, dimensions and material interchangeably.

10. The pre-fabricated pole foundation of claim 9, wherein a portion of the tapered structure is horizontally rotatable and another portion is keyed to the bridge section.

11. The pre-fabricated pole foundation of claim 9, wherein the pole cavity comprises linear grooves or protrusions and the tapered structure having an outer parameter with corresponding grooves or protrusions to facilitate sliding the tapered structure into position.

12. The pre-fabricated pole foundation of claim 9, wherein the pre-fabricated pole foundation is configured to receive a fill material from opening on top of the pole cavity and fill voids from the core up through the bridge section to a pre-set level below top of pole cavity wherein the fill material provides structural support to the embedded pole and the pre-fabricated pole foundation as a whole.

13. The pre-fabricated pole foundation of claim 9, further comprising at least one opening in the cavity wall for retaining one of power enclosures, data device enclosures, or combinations thereof.

14. The pre-fabricated pole foundation of claim 9, further comprising an opening extending through a vertical center, wherein the opening is configured to receive a ground wire through the foundation vertical center for connecting to a spike mounted to the base section for grounding a pole assembly.

15. The pre-fabricated pole foundation of claim 9, further comprising a plurality of recesses extending radially inside the pole cavity providing anchoring locations to at least pole hoisting device, pole plumbing device and pole anchoring device.

16. The pre-fabricated pole foundation of claim 15, further comprising leader bores extending radially through the cavity wall and through recesses located in an interior surface of the cavity wall, wherein the recesses receive and retain plates and bolts that to facilitate pole plumbing and retain at least one plate and one bolt for anchoring.

17. The pre-fabricated pole foundation of claim 16, wherein the recessed plates facilitate hoisting locations for the pre-fabricated pole foundation.

18. The pre-fabricated pole foundation of claim 9, wherein the pre-fabricated pole foundation is formed of a non-corrosive material.

19. A method of installing a pre-fabricated pole foundation and a pole assembly, the method comprising:
forming bore within a portion of ground soil;
hoisting and lowering a pre-fabricated pole foundation within the bore, wherein the pre-fabricated pole foundation comprises:
a cavity section having a pole cavity and cavity wall;

a bridge section having an integral or a detachable tapered structure located on a bottom end of the pole cavity within the cavity wall;

a core section having core walls; and a base section;

hoisting and lowering a pole assembly within the pole cavity of the cavity section of the pre-fabricated pole foundation;

supporting the pole assembly on the tapered structure;

pivoting the pole assembly on the tapered structure in response to operation of removable alignment devices to plumb the pole assembly;

filling with fill material open voids, in the core section and bridge section and between the pole assembly and cavity wall through the cavity section, wherein the fill material is level below a top of the cavity section;

maintaining pole alignment in response to support provided by the fill material; and capping a top opening of the cavity with a hardened material.

20. The method of claim 19, further comprising diverting moisture collection in and around the pole through the granular material.

21. The method of claim 19, further comprising grounding a pole assembly in response to extending a ground wire through a foundation vertical center opening and connecting the ground wire to a spike mounted to the base section.

22. The method of claim 19, wherein the tapered structure accommodates pole assemblies of dissimilar cross-sectional profiles, dimensions and material interchangeably.

23. The method of claim 19, wherein the pole cavity wall retains at least one enclosure and power and/or data reach the enclosure through pole cavity wall and/or pole cavity and said enclosure is accessible from pole cavity exterior.

24. A pre-fabricated pole foundation comprising:

an upper portion having a pole cavity for receiving and retaining a pole within a cavity wall; and a lower portion located below the upper portion, wherein the upper portion includes a tapered structure located at the bottom end of the pole cavity within the cavity wall, and wherein the tapered structure supports the pole and operate as a pivot point to plumb the pole using removable alignment devices wherein the tapered structure accommodates poles of dissimilar cross-sectional profiles, dimensions, and material interchangeably wherein the tapered structure is unitary with the bottom end of the pole cavity or detachable from the bottom end of the pole cavity; and a plurality of recesses in the inside of the pole cavity walls provide anchoring location to at least pole hoisting devices, pole plumb devices and pole anchoring devices, wherein the pole cavity is configured to receive fill material through the pole cavity top end and fill voids in the lower portion and between the cavity wall and the pole exterior surface to provide lateral support to the pole and maintains alignment of the embedded pole after removing the removable alignment devices.

25. The pre-fabricated pole foundation of claim 24, wherein the pre-fabricated pole foundation and the pole are configured to be separately removed from each other intact and re-used.

26. The pre-fabricated pole foundation of claim 24, further comprising at least one opening in the cavity wall for retaining one of power enclosures, data device enclosures, or combinations thereof.

27. The pre-fabricated pole foundation of claim 24, further comprising an opening extending through a vertical center, wherein the opening is configured to receive a ground wire through the foundation vertical center for connecting to a spike mounted to the base section for grounding a pole assembly.

28. The pre-fabricated pole foundation of claim 24, further comprising leader bores extending radially through the cavity wall and through recesses located in an interior surface of the cavity wall, wherein the recesses receive and retain plates and bolts that to facilitate pole plumbing and anchoring.

29. The pre-fabricated pole foundation of claim 28, wherein the recessed plates facilitate hoisting locations for the pre-fabricated pole foundation.

30. The pre-fabricated pole foundation of claim 1, wherein the bottom of the foundation base is configured to rest on a spread footing or piling, wherein the contact surface optionally employs a keyed connection.

31. The method of claim 19, further comprising removing the removable alignment devices and maintaining alignment in response to the lateral support provided by the fill material.

* * * * *